United States Patent [19]

Hoeflein et al.

[11] Patent Number: 4,843,963

[45] Date of Patent: Jul. 4, 1989

[54] SILK SCREEN PRINTING FRAME AND ASSOCIATED METHOD

[76] Inventors: Harry E. Hoeflein, 2278 Lancelot Dr., North Huntingdon, Pa. 15642; Paul A. Varrato, Waugaman Rd., R.D. #1, P.O. Box 11, Harrison City, Pa. 15636; K. J. Maderas, 529 Briar Cliff Ct., New Martinsville, W. Va. 26155

[21] Appl. No.: 141,707

[22] Filed: Jan. 7, 1988

[51] Int. Cl.[4] ..... B41F 15/34

[52] U.S. Cl. ..... 101/128; 101/129; 101/481; 101/486

[58] Field of Search ..... 101/128, 128.1, 127.1, 101/127, 112, DIG. 12, 395, 114, 115, 123, 126, 129; 33/614, 617, 621

[56] References Cited

U.S. PATENT DOCUMENTS

| | | | |
|---|---|---|---|
| 296,327 | 4/1884 | Ghezzi . | |
| 952,589 | 3/1910 | Tanner | 101/128 X |
| 1,600,177 | 9/1926 | Hurewitz | 101/128 |
| 2,369,602 | 2/1945 | Petty et al. | 101/114 |
| 2,543,714 | 2/1951 | Bednarczuk | 33/174 |
| 2,884,853 | 5/1959 | Cantoni | 101/112 |
| 3,584,385 | 6/1971 | Booth | 101/128 X |
| 3,992,989 | 11/1976 | Thompson et al. | 101/112 |
| 4,084,505 | 4/1978 | Ichinose | 101/123 |
| 4,125,658 | 11/1978 | Miles | 428/131 |
| 4,649,815 | 3/1987 | Richardson | 101/127.1 X |
| 4,750,421 | 6/1988 | Lucas | 101/128 |

OTHER PUBLICATIONS

KC Graphics, Inc., "KC Graphics Numbering Stencils", promotional flyer (Undated).

"NP Numbering Machine", Harco Graphic Products, Inc., 1987 Equipment Catalog, p. 18.

*Primary Examiner*—Clifford D. Crowder

*Attorney, Agent, or Firm*—Walter J. Blenko, Jr.

[57] ABSTRACT

A silk screen printing frame that consists of a frame that can accommodate two smaller screens that fit into the larger frame. A set of the smaller screens range from 0–9, thus a total of 20 screens will accommodate all numbers from 0-99. Alignment and centering of the numbers on the work product is accomplished by a centering and alignment indices and a uniquely configurated numeral "1" screen.

5 Claims, 5 Drawing Sheets

SILK SCREEN PRINTING FRAME AND ASSOCIATED METHOD

This invention relates to a silk screen printing frame and associated method that quickly and easily facilitates proper alignment of silk screens that print numbers and/or letters.

Silk screen printing has many applications. One of the most widely used applications is applying designs and/or numbers to athletic shirts and the like. Silk screening provides an economic, reliable, and rapid method of producing a quantity of athletic shirts with the numbers and/or designs.

In the typical silk screening process, a work product to be printed on (typically a T-shirt or athletic shirt) is stretched over a platen. After this, a silk screen printing frame is placed over top the work product. The printing frame consists of an outer frame with a silk screen stretched between the frame. The silk screen has a porous and a non-porous section. The porous section contains the design or number desired to be printed on the work product, the non-porous section encompassing the remaining portion of the silk screen.

The actual printing of the design or number on the work product is accomplished by placing a dye or ink on the silk screen and then pushing the dye through the porous section of the screen onto the work product. A squeegee or other tool is used to push the dye or ink through the porous section of the silk screen. Thus, the dye will go through the porous section containing the design and/or number but not through the non-porous section. This guarantees a perfect reproduction of the silk screen design or number onto the work product.

The screens used in silk screen printing are usually individually mounted or supported on the work product, so that when a new design is to be applied, the old design must be put aside and a new design selected. If numbers are to be printed, a different screen must be used for each different number, and the numbers must be painstakingly aligned on the work product. Of course, this process takes time.

There have been devices suggested which attempt to solve the above problems. U.S. Pat. No. 2,369,602 discloses a screen printing apparatus comprising a table and frame members and which hold a screen printing frame. The screen has letters (A-N are indicated) which can be printed on a base. The patent provides for an alignment mechanism for each letter and for the entire mounting member. Spacing blocks are also provided to properly space the blocks.

U.S. Pat. No. 2,884,853 discloses a stencil forming device which shows stencils on rollers as opposed to sliding members.

U.S. Pat. No. 2,543,714 discloses a lettering guide device. The device consists of a bottom plate 10 secured to frame 11 holding a plurality of lettering guides 12. In use, a row of stencilled lettering guides 12 is rotated to the top of the device, and the guide is moved horizontally in guideways 14 until the desired letter on the guide 12 appears in the opening.

As discussed above, it is known to provide separate silk screens for each one digit number in order to make a variety of multi digit numbers. However, a problem in the art remains in properly aligning and centering these multi digit numbers on the work product. The problem arises, mainly, because the digit "1" is not as wide as the digits "0" and "2" through "9". Thus, it is difficult to center two digit numbers including a 1, and another digit, e.g., 12, 13, 14, etc. and 21, 31, 41, etc. Previously, centering these numbers was done by sight, causing many mistakes and wasted work products.

We provide a silk screen printing frame that consists of an outer frame that can accommodate two smaller silk screen carriers that fit into the larger frame. Two sets of the smaller screens have the numbers "0"-"9" imprinted thereon, thus a total of 20 screens will accommodate all numbers from 0–99. Alignment and centering of the numbers on the work product is accomplished by centering and alignment indices and a uniquely configured number "1" silk screen carrier.

Other details, objects, and advantages of our invention will become more apparent in the following description of a present preferred embodiment of our invention.

In the accompanying drawings, we illustrate a present preferred embodiment of our invention in which.

Figure 1:
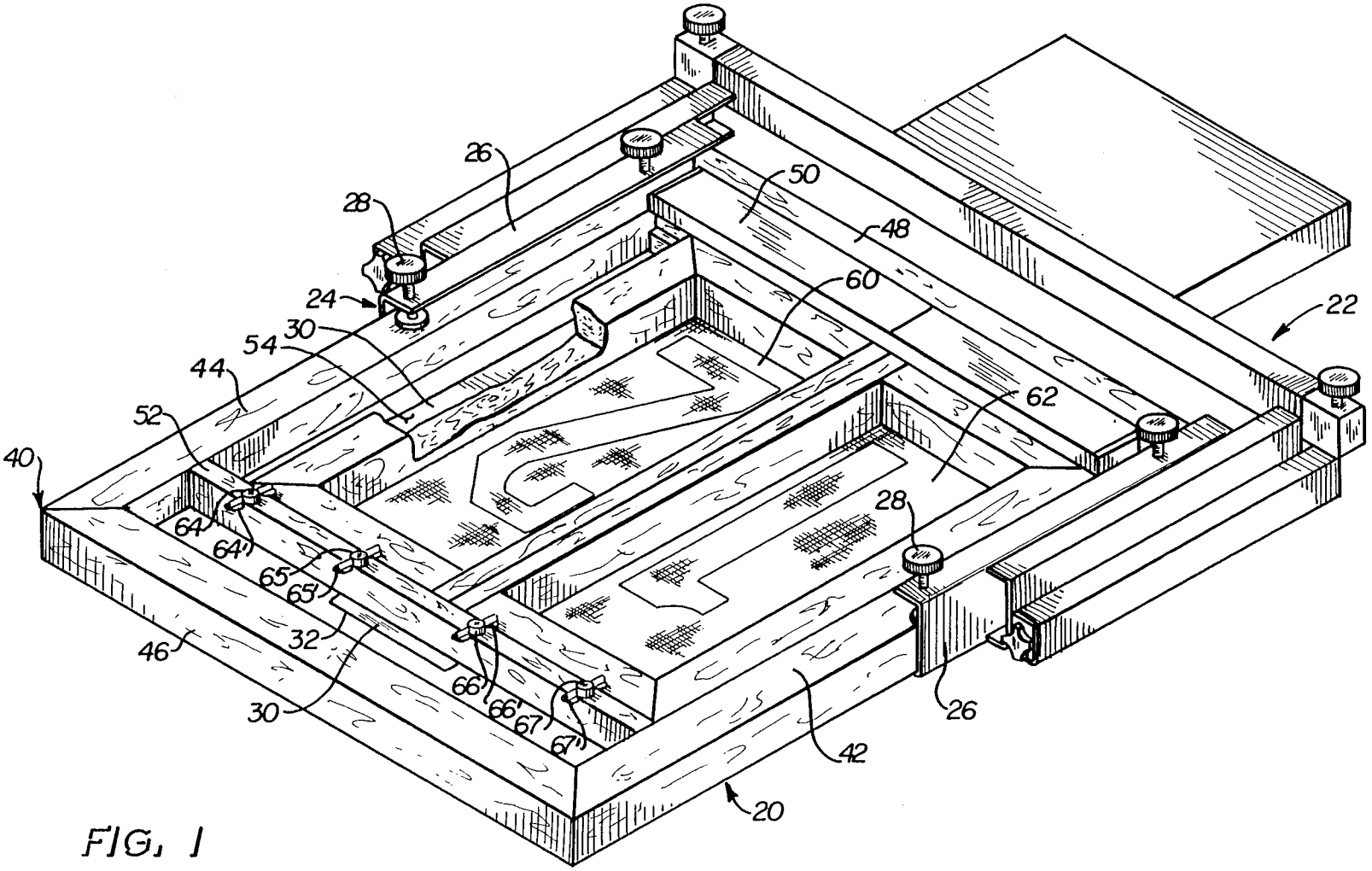
FIG. 1 is a perspective view showing the silk screen printing frame of our invention mounted on a silk screen printing machine and placed over top a platen.

Referring now more particularly to FIG. 1, there is illustrated the silk screen printing framing device 20 associated with a standard silk screening machine 22. The printing frame 20 is mounted on the machine 22, preferably, by clamping means 24 which consist of a "C" shaped frame 26 into which the frame 20 is positioned and a knob and screw means 28 which hold the frame 20 in place.

The machine 22 is equipped with a platen 30 on which a work product (not shown) such as a T-shirt is positioned. As is well known in the art, the work product is placed over the platen 30 and the frame 20 is lowered so that it is in contact with the work product.

Conventionally, if the work product is a T-shirt, the T-shirt is placed so that the neck of the T-shirt is positioned on the front 32 of the platen 30.

As can be seen in FIG. 1, the frame 20 of our invention consists of an outer framing member 40 substantially rectangular in shape having two longitudinal supports 42 and 44 and two lateral supports 46 and 48. The frame 20 is preferably made of wood, but can be constructed of other materials such as steel, aluminum, or fiberglass.

The frame 20 preferably has two crossbars 50 and 52. The longitudinal supports 42 and 44 and the crossbars 50 and 52 define a central opening 54, into which the silk screen carriers 60 and 62 are positioned. The carriers 60 and 62 will be explained in detail hereinbelow. The carriers 60 and 62 are held in position by a plurality of wing nuts 64–67 mounted in crossbar 52. The edges 64'–67' of the wing nuts are positioned so that they are in overlying contact with the upper surface of the carriers 60 and 62. It will be appreciated, however, that alternate methods can be provided for holding the screens in place such as providing dowel rods for the screens, for example.

It will be appreciated that the carriers 60 and 62 are positioned with the numbers printed thereon in an upside-down manner. This is conventional in the art, in that, as explained above, T-shirts are positioned with the neck portion towards the front 32 of the platen 30. Thus, the number that will be printed on the T-shirt in FIG. 1 will be a "12". Throughout this specification, therefore, the silk screen carrier to the left (the "2", reference number 60 in FIG. 1) will be referred to as the "one's digit" carrier and the silk screen carrier to the right (the "1", reference number 62 in FIG. 1) will be referred to as the "ten's digit" carrier.

Figure 2:
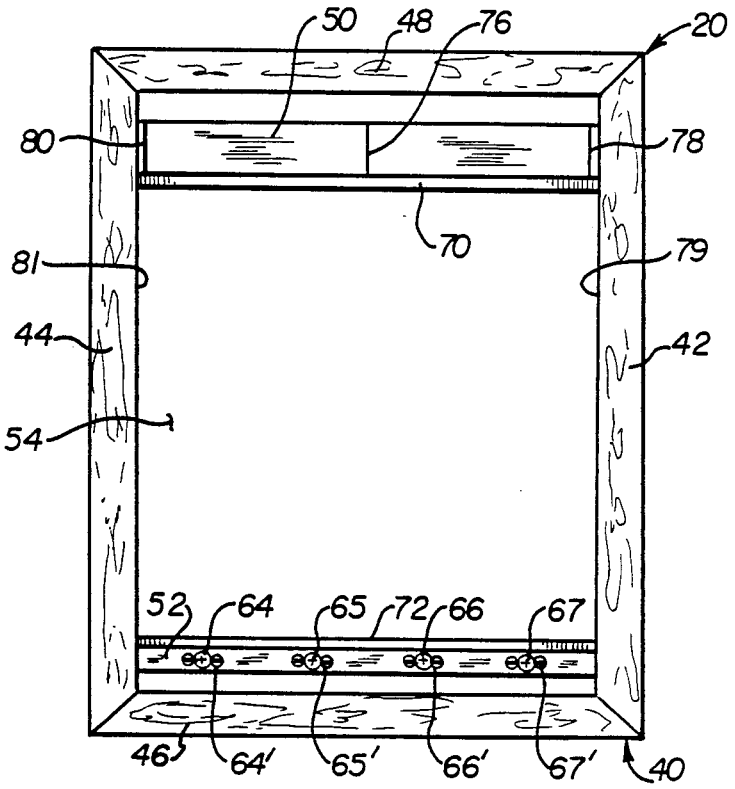
FIG. 2 is a top plan view of the outer frame of our invention, without the silk screen carriers mounted therein.

Referring now to FIG. 2, the frame 20 is shown without the carriers 60 and 62. This view shows recesses 70 and 72 which are part of the respective crossbars 50 and 52. These recesses 70 and 72 engage complementary lips on the silk screen carriers 60 and 62 (which will be shown and explained below) to further insure secure placement of the silk screen carriers 60 and 62.

Also shown in FIG. 2 are the three indices 76, 78, and 80. Index 76 is a mark preferably placed on crossbar 50 and is positioned so as to be centered in opening 54. Index 78 is also preferably placed on the crossbar 50 and is positioned on the inner edge 79 of longitudinal support 42. Index 80 is preferably placed on the crossbar 50 and is positioned on the inner edge 81 of longitudinal support 44. The function of the indices will be explained in connection with the discussion of FIGS. 11–14.

Figure 3:
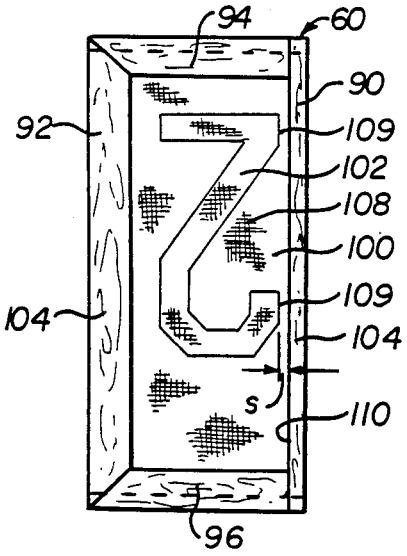
FIG. 3 is a top plan view of the "one's digit" silk screen carrier with the number "2" printed thereon.

FIGS. 3–10 illustrate the various silk screen carriers that are needed to practice the invention. Referring more particularly to FIG. 3, silk screen carrier 60 of FIG. 1 is shown. The carrier 60 is preferably substantially rectangular in shape and has an inner longitudinal support 90, an outer longitudinal support 92 and two transverse supports 94 and 96. The outer longitudinal support 92 and the transverse supports 94 and 96 are preferably substantially of the same width and height, with the inner longitudinal support 92 having the same height but preferably not being as wide as the other supports. This is because a too wide inner longitudinal support 90 will create too great of a distance between two numbers that are printed on the work product, as will be discussed below.

Figure 4:
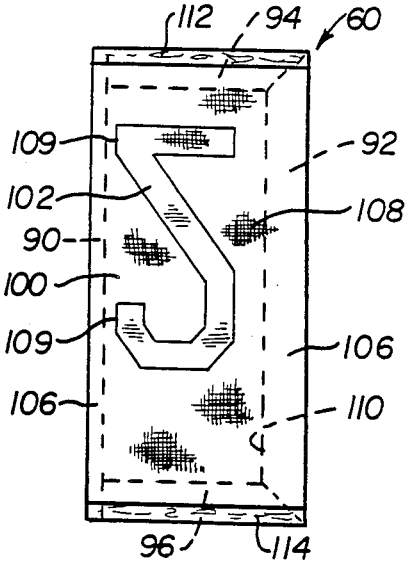
FIG. 4 is a bottom plan view of the silk screen carrier of FIG. 3.

A silk screen 100 with a number 102 (here "2") associated therewith is mounted to the bottom of the carrier 60. Thus, FIG. 3 shows the screen being recessed from the top edge 104 of the carrier 60, whereas FIG. 4 shows the screen 100 mounted on the same plane as that formed by the bottom edge 106 of the carrier.

The silk screen 100, well known to those skilled in the art, is made of synthetic fibers or the like. The number 102 is made of the same materials, however, it is made so that an ink or dye may be forced through the openings created to make the number. As is well known to those skilled in the art, dye or ink is placed on the screen carrier 60 and is spread over the surface of the screen 100. A squeegee or similar tool is then dragged across the screen 100, forcing the dye or ink through the porous portion of the screen 100, which forms the number 102 desired to be printed. Ink or dye cannot go through the non-porous portion 108. Thus, the ink is placed on the work product to form the number 102 (here "2") on the silk screen carrier 60.

Preferably each number 102, (0–9, except 1 which will be discussed below) is of substantially the same height and width. For the one's digit screens, (of which screen 60 is an example) the inner edge 109 of the numbers 102 are preferably all positioned about $\frac{1}{2}''$ to $\frac{5}{8}''$ from the inner edge 110 of the inner longitudinal support 90. It will be appreciated that the exact distance is not important; however, the inner edge 109 of the one's digit screen set 0–9 (including "1") will all be spaced this same distance ("s") from the inner edge 110 of the longitudinal support 90. This factor will be important in positioning two digit numbers 102 on the work product.

Referring again to FIG. 4, the complementary lips 112 and 114 associated with the respective transverse supports 94 and 96 are shown. These lips 112 and 114 engage the recesses 70 and 72 of the frame 40 to insure a tight secure fit of the carrier 60 in the frame 40.

Figure 5:
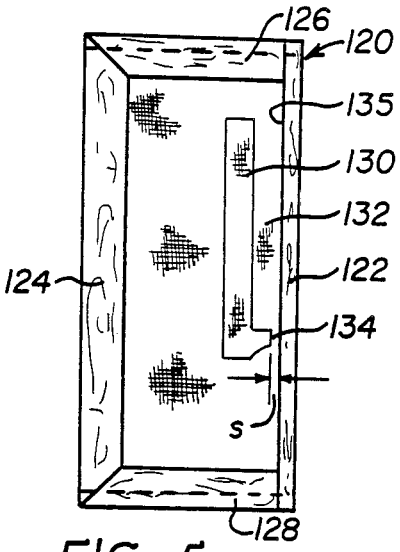
FIG. 5 is a top plan view of the "one's digit" silk screen carrier with the number "1" printed thereon.
Figure 6:
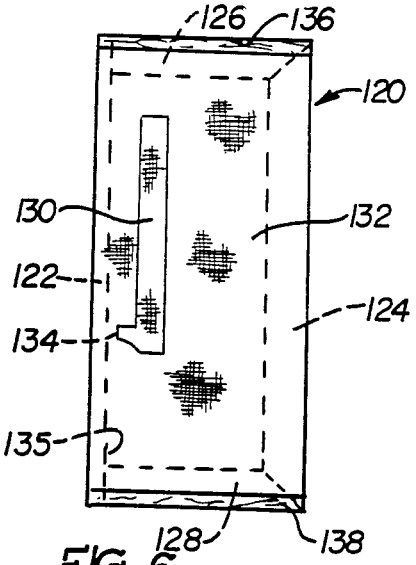
FIG. 6 is a bottom plan view of the silk screen carrier of FIG. 5.

Referring now to FIG. 5, the one's digit carrier with the number "1" associated therewith 120 will be described. (This carrier is not shown in FIG. 1.) As with carrier 60, this carrier 120 has an inner longitudinal support 122 and an outer longitudinal 124 support and two transverse supports 126 and 128. The number "1" 130 is positioned on screen 132 so that the distance between the inner edge 134 of the number 130 and the inner edge 135 of the longitudinal support 122 ("s") is equal to that of the other carriers (for number 0 and 2–9). This distance "s" is also equal to the distance "s" between the inner edge 110 and the longitudinal support 90 of carrier 60 discussed above. It will be noted that the number "1" 130 is not as wide as the other numbers "0" and "2–9", however, every other aspect of this carrier 120 is the same as carrier 120, including the provision of lips 136 and 138 on the bottom of the carrier 120 as shown in FIG. 6.

Figure 7:
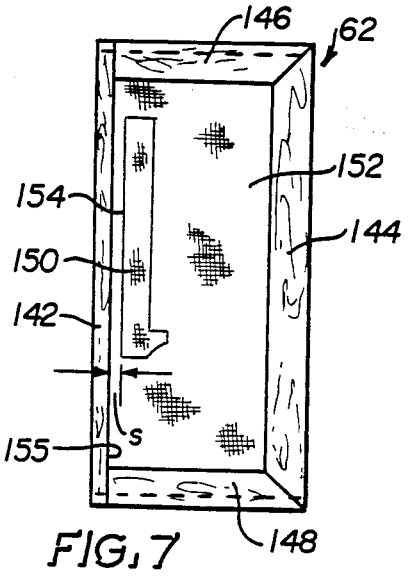
FIG. 7 is a top plan view of a "ten's digit" silk screen carrier with the number "1" printed thereon.
Figure 8:
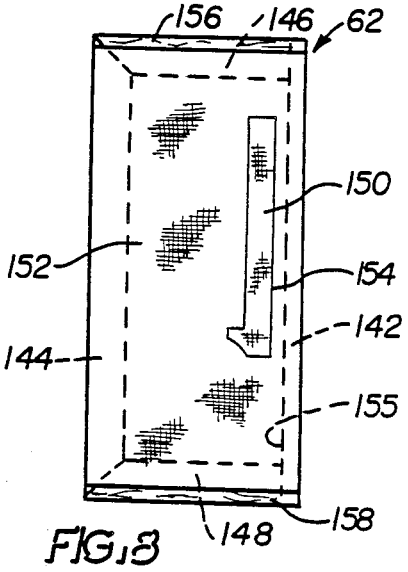
FIG. 8 is a bottom plan view of the silk screen carrier of FIG. 7.

Referring now to FIG. 7, the carrier 62 of FIG. 1 is shown. This carrier 62 is for the "ten's digit". This carrier 62 has an inner longitudinal support 142, an outer longitudinal support 144 and two transverse supports 146 and 148. The number "1" 150 is positioned on the screen 152 so that the distance between the inner edge 154 and the inner edge 155 of the longitudinal support 142 ("s") is equal to the corresponding distance with respect to the carriers 60 and 120 discussed above. This carrier 62 is similar to carrier 60 and 120 with respect to the dimensions of the supports 142, 144, 146, and 148, the screening 152 and the provisions of lips (reference numbers 156 and 158) on the bottom of the carrier 62 as shown in FIG. 8.

Figure 9:
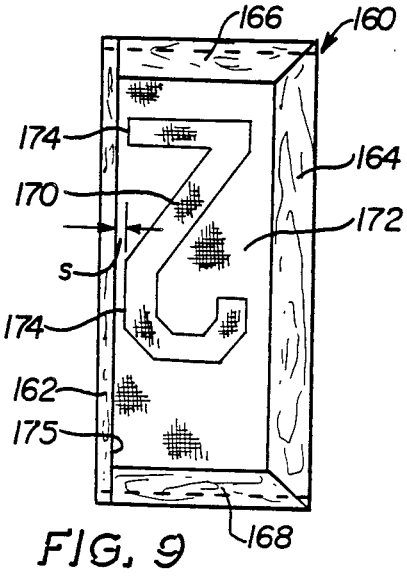
FIG. 9 is a top plan view of a "ten's digit" silk screen carrier with the number "2" printed thereon.
Figure 10:
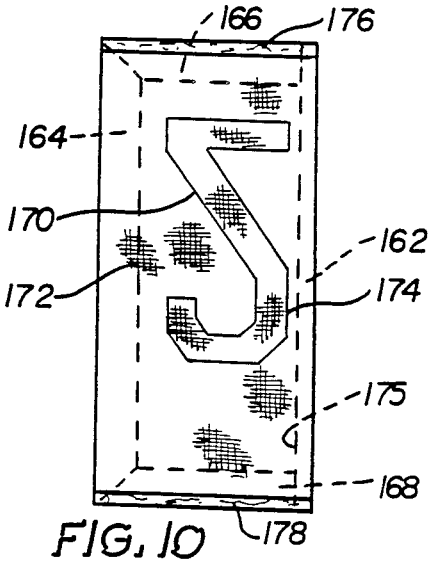
FIG. 10 is a bottom plan view of the silk screen carrier of FIG. 9.

Referring now to FIG. 9, the carrier 160 is shown. This carrier 160 is for the "ten's digit", for the numbers 0 and 2–9. This carrier is not shown in FIG. 1. This carrier 160 has an inner longitudinal support 162, an outer longitudinal support 164, and two transverse supports 166 and 168. The number "2" 170 is positioned on the screen 172 so that the distance between the inner edge 174 and the inner edge 175 of the longitudinal support 162 ("s") is equal to the corresponding distance with respect to carriers 60, 62, and 120. This carrier 160 is similar to the other carriers 60, 62, and 120 with respect to the dimensions of the supports 162, 164, 166, and 168, the screening 162 and the provisions of lips (reference numbers 176 and 178) on the bottom of the carrier 160 as shown in FIG. 10.

It will be appreciated that, preferably, there will be two sets having ten carriers each; one set (0–9) for the one's digit numbers (FIGS. 3–6) and one set (0–9) for the ten's digit numbers (FIGS. 7–10). The distinguishing factor between the one's digit screen set and the ten's digit screen set is that the one's digit screens have the thinner inner longitudinal support (90 and 122) on the right side and the ten's digit screens have the thinner inner longitudinal support (122 and 142) on the left side. The numbers 0 and 2–9 should preferably be the same height and width with the number "1" screens (reference numbers 62 and 120) having a similar height but a lesser width.

It will be appreciated that the method of the invention is to provide a silk screen printing frame 20 and silk screen carriers substantially as described hereinabove, mounting the frame 20 with the silk screen carriers on a silk screen printing machine 22, placing the frame 20 on top of a work product, introducing ink or dye onto the silk screen held by the silk screen carrier and urging the ink through the porous portions of the silk screen in order to print the appropriate number on a work product.

Figure 11:
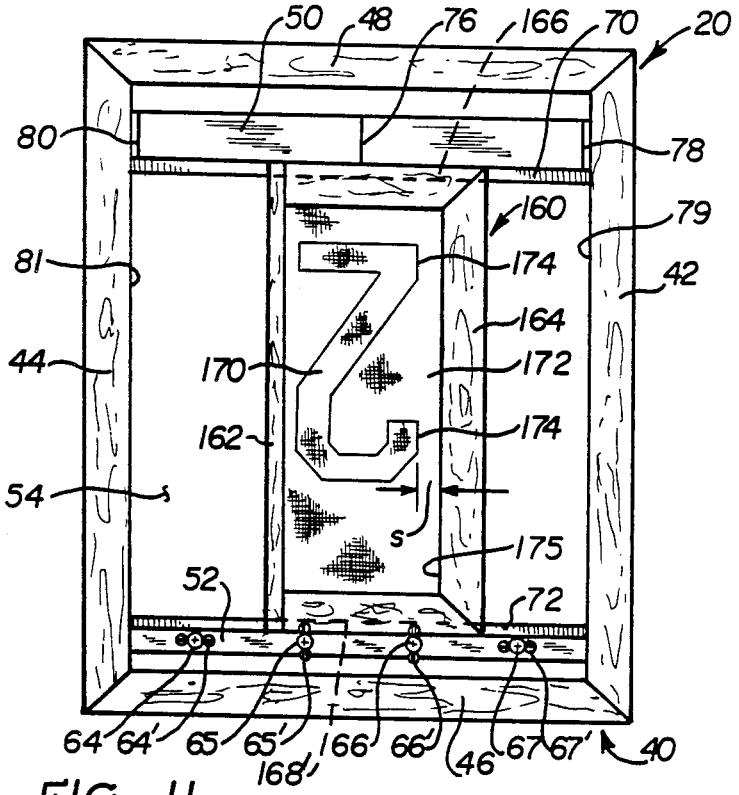
FIG. 11 is a top plan view of the invention illustrating how single digit numbers are printed on a work piece, specifically showing the number "2".

Referring now to FIGS. 11–14, the specific methods of the invention 20 to print numbers from 0–99 on a work product will be described. Referring specifically to FIG. 11, the method of printing a single digit, for example a "2", on a work product is shown. In this case, the carrier from the "one's digit set" or the "ten's digit set " may be used. The exemplary screen carrier 160 is from the ten's digit set.

In order to properly center and align a single digit on the frame 20, the operator first places the carrier 160 in the opening, 54 by engaging the lips of the carrier 176 and 178 (FIG. 10) with the recesses 70 and 72 of the frame, then aligns the carrier 160 in the frame 40 by centering the number "2" 170 by using the centering index 76, and finally rotates the wing nuts 65 and 66 to secure the carrier 16 in place. The frame 20 is then ready for use on a work product.

Figure 12:
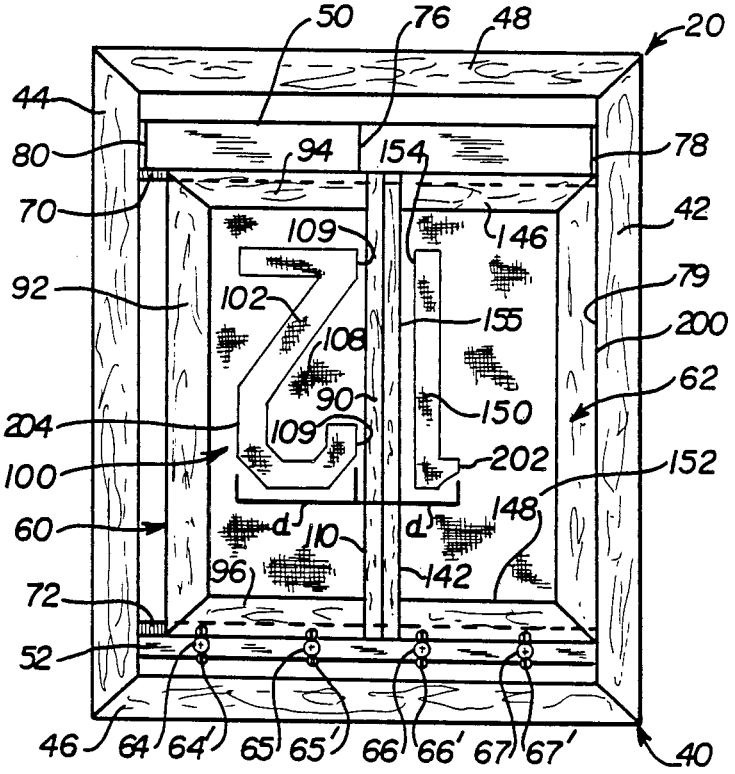
FIG. 12 is a top plan view of the invention illustrating how the numbers "10" and "12"-"19" are printed on a work piece, specifically showing the number "12".

Referring now to FIG. 12, the method of printing the numbers "10" and "12–19", for example a 12, is shown. In this case, the carrier for "2" 60 is chosen from the one's digit set and the carrier for the "1" 62 is chosen from the ten's digit set. In order to properly center the number "12" on the work product, the carriers 60 and 62 are initially placed in the frame in the same way that carrier 160 (FIG. 11) was placed in the frame 20. This time, however, carrier 62 is slid so that longitudinal support 144 of the carrier 62 is in contact with the inner edge 79 of longitudinal support 42 of the frame 40. Also, the outer edge 200 of the longitudinal support 144 of the carrier 62 is aligned with the right index 78. Carrier 60 is then slid to a position where its inner longitudinal support 90 is in contact with the longitudinal support 142 of carrier 62.

It will be appreciated that because of the configuration of the carriers 60 and 62, that the numbers "10" and "12" through "19" will always be centered on the work product if the above steps are followed. This is illustrated by measuring the two distance between the centering index 76 and the outer edges of the numbers "1" 202 and "2" 204. The distance, "d", between the centering index 76 and the outer edge of the number "1" 202 is approximately equal to the distance "d" between the centering index 76 and outer edge of the number "2" 204 for both numbers. This is because the numbers 102 and 150 are positioned on similar dimensioned screen carriers 60 and 62 and because the inner edges 109 and 154 of the respective numbers 102 and 150 are an equal distance from the inner edges 110 and 155 of their respective longitudinal supports 142 and 110.

Figure 13:
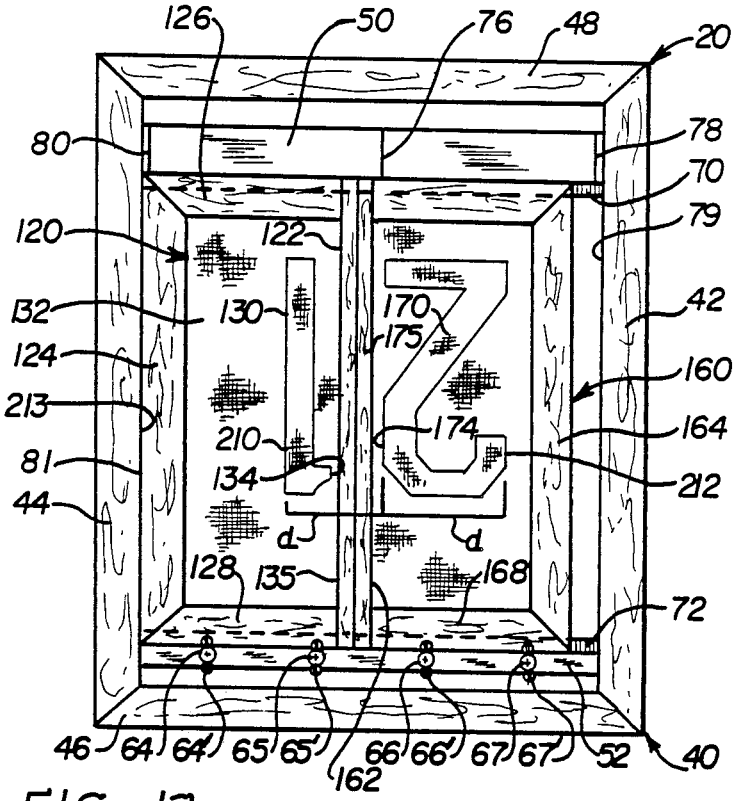
FIG. 13 is a top plan view illustrating how the numbers with a "1" in the one's digit, except the number 11, (i.e., 21, 31, 41, etc.), are printed on a work piece, specifically showing the number "21".

Referring now to FIG. 13, the method of printing the numbers "21", "31", "41", "51", "61", "71", "81", and "91", for example a "21", is shown. Here, the carrier for the "1" 120 is chosen from the one's digit set and the carrier for the "2" 160 is chosen from the ten's digit set.

In order to properly center the number "21" on the work product, the carriers 120 and 160 are placed in the frame 40 in the same way that carrier 160 (FIG. 11) was initially placed in the frame 20. This time carrier 120 is slid so that longitudinal support 124 of carrier 120 is in contact with the inner edge 81 of longitudinal support 44 of the frame 40. Also, the outer edge 213 of longitudinal support 124 is aligned with the left index 80. Carrier 160 is then slid to a position where its inner longitudinal support 162 is in contact with the longitudinal support 122 of carrier 120.

It will be appreciated that, again because of the configuration of the carriers 120 and 160, that the numbers "21", "31", etc. will always be centered on the work product if the above steps are followed. This is illustrated by measuring the distance between the centering index 76 and the outer edges of the numbers "2" 212 and "1" 210. This distance "d" between the centering index 76 and the outer edge of the number "2" 212 is approximately equal to the distance "d" between the centering index 76 and the outer edge of the number "1" 210. This is because the numbers 130 and 170 are positioned on similar dimensioned screen carriers 120 and 160 and because the inner edges 134 and 174 of the numbers 102 and 150 are an equal distance from the inner edges 135 and 175 of the longitudinal supports 122 and 162.

Figure 14:
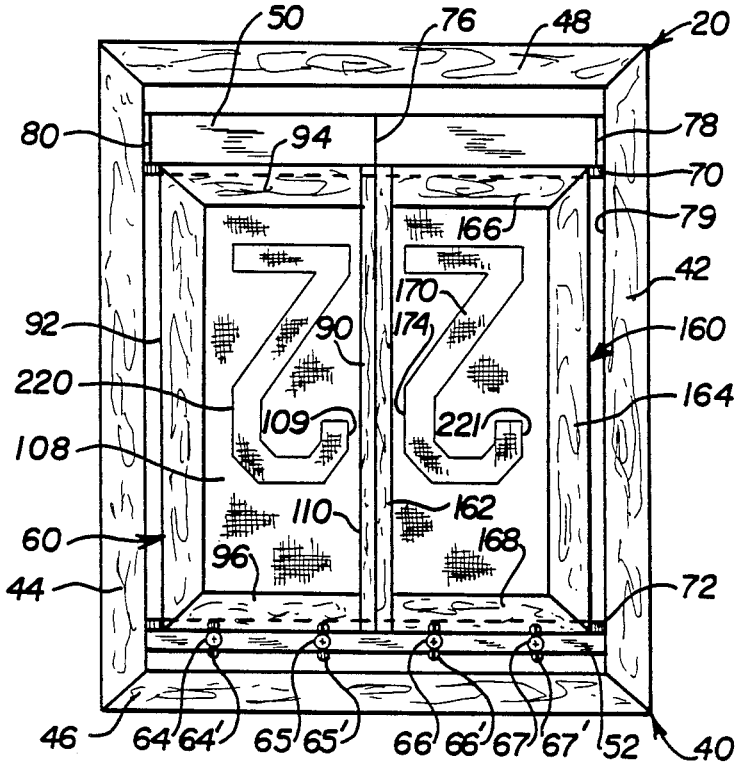
FIG. 14 is a top plan view illustrating how the remaining two digit numbers (i.e., 11, 22, 36, 99) are printed on a work piece, specifically showing the number "22".

Finally, referring to FIG. 14, the method of printing the remaining two digit numbers ("11", "22", "36", "95", etc.) will be illustrated. Here, the carrier for the "2" 60 is chosen from the one's digit set and the carrier for the other "2" 160 is chosen from the ten's digit set.

In order to properly center the number "22" on the work product, the carriers 60 and 160 are placed in the frame 40 in the same way that carrier 160 (FIG. 11) was initially placed in the frame 40. Here, the inner longitudinal supports of the respective carrier 90 and 162 are in contact with each other such that the centering index 76 is at a point where the outer edges of the inner longitudinal supports 90 and 162 of the respective silk screen carriers meet. This will insure that the number "22" will be centered.

It will be appreciated that the silk screen printing frame 20 provides a reliable, foolproof, and easy method of insuring that numbers printed on a work product will be properly centered, even if the number contains a "1" in either the one's digit or the ten's digit.

While we have illustrated and described a present embodiment of the invention, it is to be understood that the invention is not limited thereto and may be otherwise variously practiced within the scope of the following claims.

We claim:

1. A silk screen printing frame consisting of a framing member defining a central opening, at least one silk screen carrier, each of said silk screen carriers being disposed within said central opening, each silk screen carrier having an inner and an outer longitudinal support and two transverse supports, each of said silk screen carriers having a silk screen attached thereto, said silk screen having a single digit number imprinted thereon, said number having an inner edge and an outer edge and positioned on said silk screen so that the distance between the inner edge of said inner longitudinal support and said inner edge of said number is approximately equal for each said silk screen carrier, said framing member having a centering index and two edge indices, whereby alignment of said numbers is accomplished by using said indices to insure that the distance between the centering index and said outer edge of one of said numbers is substantially equal to the distance between said centering index and said outer edge of said other number, said framing member being substantially rectangular in shape and having two longitudinal support means and two lateral support means, said framing member adapted to be mounted onto a silk screening machine means, said framing member having recess means for engagement with complementary lip means on said silk screen carriers, whereby a secure placement of said silk screen carrier is facilitated in said framing member, said framing member having securement means for holding said silk screen carriers in said framing member, and said securement means being wing nuts mounted on said framing member, whereby the edges of said wing nuts are in overlying contact with the upper surface of said silk screen carriers.

2. The silk screen printing frame of claim 1, including two sets of silk screen carriers, one set consisting of ten one's digit silk screen carriers each having one of the single digit numbers 0–9 imprinted on said silk screens associalted with each said silk screen carrier and a second set consisting of ten ten's digit silk screen carriers each having one of the signal digit numbers 0–9 imprinted on said silk screens associated with each said silk screen carrier, whereby numbers from 0 through 99 can be printed on a work product by using two sets of silk screen carriers.

3. A method of silk screen printing numbers on a work product, including providing a silk screen printing machine having mounting means, providing a silk screen printing frame consisting of a framing member defining a central opening, at least one silk screen carrier having an inner and an outer longitudinal support and two transverse supports being disposed within said central opening, said silk screen carries each having a signal digit number imprinted thereon, said number having an inner edge and an outer edge and positioned on said silk screen so that the distance between the inner edge of said inner longitudinal support and said inner edge of said number is approximately equal for each said silk screen carrier and said framing member having a centering index and two edge indices, providing two sets of silk screen carriers, one set consisting of ten ten's digit silk screen carriers each having one of the single digit numbers 0–9 imprinted on said silk screen carrier and a second set consisting of ten ten's digit silk screen carriers each having one of the single digit numbers 0–9 imprinted on said silk screens associated with each said silk screen carrier, imprinting the numbers "10" and "12"–"19" on a work product by placing the appropriate silk screen carrier from said set of one's digit silk screen carriers and the number "1" silk screen carrier from said set of ten's digit silk screen carrier into said framing member, sliding said number "1" silk screen carrier over so that the edge of said number "1" silk screen carrier is aligned with one of said edge indices, sliding said appropriate one's digit silk screen carrier so that said inner longitudinal support of said appropriate one's digit silk screen carrier is in contac with said inner longitudinal edge of said number "1" silk screen carrier, mounting said silk screen printing frame onto said silk screen printing machine, placing said silk screen printing frame on top of said work product, introducing ink means onto said silk screen, and urging said ink means through said silk screen onto said work product, whereby one of the numbers including "10" or "12"–"19" is printed on said work prouct.

4. A method of silk screen printing numbers on a work product, including providing a silk screen printing machine having mounting means, providing a silk screen printing frame consisting of a framing member defining a central opening, at least one silk screen carrier having an inner an an outer longitudinal support and two transverse supports being disposed within said central opening, said silk screen carriers each having a single digit number imprinted thereon, said number having an inner edge and an outer edge and positioned on said silk screen so that the distance between the inner edge of said inner longitudinal support and said inner edge of said number is approximately equal for each said silk screen carrier and said framing member having a centering index and two edge indices, providing two sets of silk screen carriers, one set consisting of ten ten's digit silk screen carriers each having one of the single digit numbers 0–9 imprinted on said silk screen carrier and a second set consisting of ten ten's digit silk screen carriers each having one of the single digit numbers 0–9 imprinted on said silk screens associated with each said silk screen carrier, imprinting the numbers "21", "31", "41", "51", "61", "71", "81", and "91" on a work product by placing the number "1" silk screen carrier from said set of one's digit silk screen carriers and the appropriate silk screen carrier from said set of ten's digit silk screen carriers into said framing member, sliding said number "1" silk screen carrier over so that the edge of said number "1" silk screen carrier is aligned with one of said edge indices, sliding said appropriate ten's digit silk screen carrier so that said inner longitudinal support of said appropriate ten's digit screen carrier is in contact with said inner longitudinal edge of said number "1" silk screen carrier, mounting said silk screen printing frame onto said silk screen printing machine, placing said silk screen printing frame on top of said work product, introducing ink means onto said silk screen, and urging said ink means through said silk screen onto said work product, whereby one of the numbers including "21", "31", "41", "51", "61", "71", "81", and "91" is printed on said work product.

5. A method of silk screen printing numbers on a work product, including providing a silk screen printing machine having mounting means, providing a silk screen printing frame consisting of a framing member defining a central opening, at least one silk screen carrier having an inner and an outer longitudinal support and two transverse supports being disposed within said central opening, said silk screen carriers each having a single digit number imprinted thereon, said number having an inner edge and an outer edge and positioned on said silk screen so that the distance between the inner edge of said inner longitudinal support and said inner edge of said number is approximately equal for each said silk screen carrier and said framing member having a centering index and two edge indices, providing two sets of silk screen carriers, one set consisting of ten ten's digit silk screen carriers each having one of the single digit numbers 0–9 imprinted on said silk screen carrier and a second set consisting of ten ten's digit silk screen carriers each having one of the single digit numbers 0–9 imprinted on said silk screens associated with each said silk screen carrier, whereby numbers from 0–99 can be imprinted on a work product by using said two sets of silk screen carriers, imprinting all two digit numbers except "10", "12"–"19", and "21", "31", "41", "51", "61", "71', "81", and "91" by placing the appropriate silk screen carrier from said set of one's digit silk screen carriers and the appropriate silk screen carrier from set of ten's digit silk screen carriers into said said framing member, sliding said one's digit carrier so that the outer edge of said inner longitudinal support of said carrier is aligned with said centering index, sliding said ten's digit carrier so that the outer edge of said inner longitudinal support of said carrier is aligned with said centering index, mounting said silk screen printing frame onto said silk screen printing machine, placing said silk screen printing frame on top of said work product, introducing ink means onto said silk screen, and urging said ink means through said silk screen onto said work product, whereby one of a group of two digit numbers except "10", "12"–"19", and "21", "31", "41", "51", "61", "71", "81", and "91" is printed on said work product.

* * * * *